US010204567B2

(12) United States Patent
Yang et al.

(10) Patent No.: US 10,204,567 B2
(45) Date of Patent: Feb. 12, 2019

(54) BACKLIGHT AND DISPLAY DEVICE

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Shengji Yang, Beijing (CN); Xiaochuan Chen, Beijing (CN); Panhua Wang, Beijing (CN); Xue Dong, Beijing (CN); Hailin Xue, Beijing (CN); Haisheng Wang, Beijing (CN); Yingming Liu, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 258 days.

(21) Appl. No.: 15/200,323

(22) Filed: Jul. 1, 2016

(65) Prior Publication Data

US 2017/0193927 A1 Jul. 6, 2017

(30) Foreign Application Priority Data

Jan. 4, 2016 (CN) ..... 2016 1 0003501

(51) Int. Cl.
*G09G 3/36* (2006.01)
*G09G 3/34* (2006.01)
*G09G 3/3225* (2016.01)

(52) U.S. Cl.
CPC ..... *G09G 3/3426* (2013.01); *G09G 3/3225* (2013.01); *G09G 3/36* (2013.01);
(Continued)

(58) Field of Classification Search
CPC .... G09G 3/34; G09G 3/36; F21V 7/04; G02F 1/13; G02F 1/1335; G02F 1/1333; G02F 1/1368; G02F 1/1339; H01L 27/12
See application file for complete search history.

(56) References Cited

U.S. PATENT DOCUMENTS

2005/0259093 A1* 11/2005 Osame ..... G09G 3/3241 345/204
2007/0242031 A1* 10/2007 Kimura ..... G02F 1/133603 345/102
(Continued)

FOREIGN PATENT DOCUMENTS

CN 101075413 A 11/2007
CN 101162563 A 4/2008
(Continued)

OTHER PUBLICATIONS

First Office Action dated Sep. 21, 2017 in corresponding Chinese Patent Application No. 201610003501.4.

*Primary Examiner* — Pegeman Karimi
(74) *Attorney, Agent, or Firm* — Nath, Goldberg & Meyer; Joshua B. Goldberg; Daniel Bissing

(57) ABSTRACT

The invention provides a backlight and a display device, the backlight includes multiple backlight scanning lines and multiple backlight data lines, which are provided in different layers and are intersected with each other to divide the backlight into a plurality of light-emitting units, each of which is provided with one light-emitting diode and a light-emitting circuit for driving the light-emitting diode to emit light, the light-emitting circuits for a same row of light-emitting units are electrically connected to a corresponding backlight scanning line, the light-emitting circuits for a same column of light-emitting units are electrically connected to a corresponding backlight data line, the backlight scanning line is configured for providing a scanning
(Continued)

signal to the light-emitting circuit, and the backlight data line is configured for providing a gray scale signal to the light-emitting circuit to control brightness of the light-emitting unit.

19 Claims, 6 Drawing Sheets

(52) U.S. Cl.
CPC ..... *G09G 2300/023* (2013.01); *G09G 2300/0809* (2013.01); *G09G 2300/0814* (2013.01); *G09G 2300/0819* (2013.01); *G09G 2320/0646* (2013.01)

(56) References Cited

U.S. PATENT DOCUMENTS

| | | | | |
|---|---|---|---|---|
| 2007/0268240 | A1* | 11/2007 | Lee | G09G 3/3426 345/102 |
| 2010/0110058 | A1* | 5/2010 | Moh | G09G 3/3655 345/211 |
| 2010/0253881 | A1 | 10/2010 | Han et al. | |
| 2016/0042703 | A1* | 2/2016 | Fan | G09G 3/3607 345/88 |
| 2017/0206843 | A1 | 7/2017 | Liu et al. | |

FOREIGN PATENT DOCUMENTS

| | | | |
|---|---|---|---|
| CN | 101344231 | A | 1/2009 |
| CN | 101441351 | A | 5/2009 |
| CN | 104898322 | A | 9/2015 |

* cited by examiner

BACKLIGHT AND DISPLAY DEVICE

FIELD OF THE INVENTION

The present invention relates to the field of display technology, and in particular, relates to a backlight and a display device.

BACKGROUND OF THE INVENTION

A liquid crystal display device includes a liquid crystal display panel and a backlight. In the prior art, the backlight includes a light-emitting part and an optical film.

There are two kinds of backlights. In the first kind of backlight, the light-emitting part is generally provided at a side of the optical film, that is, brightness of the entire backlight is uniform. In the second kind of backlight, the backlight is divided into a plurality of regions, each of which includes a corresponding light-emitting part and a corresponding optical film, and brightness in each region can be individually controlled. Thus, such a backlight is referred to as a "local dimming" backlight. Brightness in the respective regions of the backlight can be adjusted based on the image to be displayed, so as to increase the contrast of the image to obtain a better display effect.

However, in the "local dimming" backlight, the number of the divided regions is limited, and thus it is difficult to obtain a better display effect. Thus, how to achieve a backlight including a plurality of light-emitting regions is a technical problem to be solved urgently in the art.

SUMMARY OF THE INVENTION

An object of the invention is to provide a backlight and a display device. The backlight can be divided into a plurality of light-emitting regions so that the backlight and the display device have a better display effect.

In order to achieve the above object, a backlight is provided to supply a light source for a display panel, wherein the backlight includes a plurality of backlight scanning lines and a plurality of backlight data lines, the plurality of backlight scanning lines and the plurality of backlight data lines are provided in different layers, and the plurality of backlight scanning lines and the plurality of backlight data lines are intersected with each other to divide the backlight into a plurality of light-emitting units, each of which is provided therein with one light-emitting diode and a light-emitting circuit for driving the light-emitting diode to emit light, the light-emitting circuits for a same row of light-emitting units are electrically connected to a corresponding backlight scanning line, the light-emitting circuits for a same column of light-emitting units are electrically connected to a corresponding backlight data line, the backlight scanning line is configured for providing a scanning signal to the light-emitting circuit, and the backlight data line is configured for providing a gray scale signal to the light-emitting circuit to control brightness of the light-emitting unit.

Preferably, the backlight is divided into at least two light-emitting regions, each light-emitting region includes at least one light-emitting unit, the light-emitting diodes in a same light-emitting region share a cathode, and the light-emitting diodes in different light-emitting regions correspond to different cathodes.

Preferably, the light-emitting circuit includes a gray scale signal input unit, a driving transistor, an energy storage unit, a compensation unit and a high level signal input terminal, a gate of the driving transistor is electrically connected to a first terminal of the energy storage unit, and a second terminal of the energy storage unit is electrically connected to the high level signal input terminal;

a control terminal of the gray scale signal input unit is electrically connected to a corresponding backlight scanning line, an input terminal of the gray scale signal input unit is electrically connected to a corresponding backlight data line, an output terminal of the gray scale signal input unit is electrically connected to a first electrode of the driving transistor, and when a valid scanning signal received by the backlight scanning line and a gray scale signal input by the backlight data line is received by the control terminal of the gray scale signal input unit, the input terminal and the output terminal of the gray scale signal input unit are conductive so as to store the gray scale signal in the energy storage unit;

a control terminal of the compensation unit is electrically connected to the backlight scanning line, an input terminal of the compensation unit is electrically connected to a second electrode of the driving transistor, an output terminal of the compensation unit is electrically connected to the first terminal of the energy storage unit, and when a valid scanning signal output by the backlight scanning line is received by the control terminal of the compensation unit, the input terminal and the output terminal of the compensation unit are conductive so as to store a threshold voltage of the driving transistor in the energy storage unit.

Preferably, the light-emitting circuit further includes a reset unit and a reset voltage input terminal, a control terminal of the reset unit is electrically connected to a reset signal input terminal, a first input terminal of the reset unit is electrically connected to the gate of the driving transistor, a second input terminal of the reset unit is electrically connected to the reset voltage input terminal, and when a valid reset signal is received by the control terminal of the reset unit, the first input terminal and the second input terminal of the reset unit are conductive.

Preferably, the backlight further includes a plurality of light-emitting control lines, each row of light-emitting units correspond to one light-emitting control line, the light-emitting circuit further includes a first light-emitting control unit, a control terminal of the first light-emitting control unit is electrically connected to the light-emitting control line, an input terminal of the first light-emitting control unit is electrically connected to the second electrode of the driving transistor, an output terminal of the first light-emitting control unit is electrically connected to an anode of the light-emitting diode, and when the light-emitting control line provides a valid light-emitting control signal, the input terminal and the output terminal of the first light-emitting control unit are conductive.

Preferably, the light-emitting circuit further includes a second light-emitting control unit, an input terminal of the second light-emitting control unit is electrically connected to the high level signal input terminal, an output terminal of the second light-emitting control unit is electrically connected to the first terminal of the driving transistor, a control terminal of the second light-emitting control unit is electrically connected to the light-emitting control line, and when the light-emitting control line provides the valid light-emitting control signal, the input terminal and the output terminal of the second light-emitting control unit are conductive.

Preferably, the first light-emitting control unit includes a first light-emitting control transistor, a gate of the first light-emitting control transistor serves as the control terminal of the first light-emitting control unit, a first electrode of the first light-emitting control transistor serves as the input terminal of the first light-emitting control unit, and a second electrode of the first light-emitting control transistor serves as the output terminal of the first light-emitting control unit.

Preferably, the second light-emitting control unit includes a second light-emitting control transistor, a gate of the second light-emitting control transistor serves as the control terminal of the second light-emitting control unit, a first electrode of the second light-emitting control transistor serves as the input terminal of the second light-emitting control unit, and a second electrode of the second light-emitting control transistor serves as the output terminal of the second light-emitting control unit.

Preferably, the gray scale signal input unit includes a gray scale signal input transistor, a gate of the gray scale signal input transistor serves as the control terminal of the gray scale signal input unit, a first electrode of the gray scale signal input transistor serves as the input terminal of the gray scale signal input unit, and a second electrode of the gray scale signal input transistor serves as the output terminal of the gray scale signal input unit.

Preferably, the compensation unit includes a compensation transistor, a gate of the compensation transistor serves as the control terminal of the compensation unit, a first electrode of the compensation transistor serves as the input terminal of the compensation unit, and a second electrode of the compensation transistor serves as the output terminal of the compensation unit.

Preferably, the reset unit includes a reset transistor, a gate of the reset transistor serves as the control terminal of the reset unit, a first electrode of the reset transistor serves as the first terminal of the reset unit, and a second electrode of the reset transistor serves as the second terminal of the reset unit.

Preferably, the backlight includes a shift register, the shift register includes a plurality of stages of shift register units which are cascaded, the shift register unit includes a scanning signal output module and a light-emitting control signal output module, the scanning signal output module is configured for providing a scanning signal to the backlight scanning line of the backlight, and the light-emitting control signal output module is configured for providing a light-emitting control signal to the light-emitting control signal line of the backlight.

Preferably, a control terminal of the light-emitting control signal output module is electrically connected to an output terminal of the scanning signal output module, and the light-emitting control signal output module is able to output the light-emitting control signal after receiving the scanning signal output by the scanning signal output module.

Preferably, the shift register includes a first level signal input terminal, a second level signal input terminal, a first clock signal terminal and a second clock signal terminal, timing of a first clock signal input by the first clock signal terminal is 180° out-of-phase with respect to timing of a second clock signal input by the second clock signal terminal, and when a valid scanning signal is output by the output terminal of the scanning signal output module, the second clock signal is a valid signal, a first level signal input by the first level signal input terminal is an invalid signal, and a second level signal input by the second level signal input terminal is a valid signal;

the scanning signal output module includes a first output transistor, a second output transistor, a first output control sub-module, a scanning signal input sub-module, a first energy storage sub-module and a second energy storage sub-module;

a first electrode of the first output transistor is electrically connected to the first level signal input terminal, a gate of the first output transistor is electrically connected to the first terminal of the scanning signal input sub-module, and a second electrode of the first output transistor is electrically connected to the output terminal of the scanning signal output module;

a first electrode of the second output transistor is electrically connected to the output terminal of the scanning signal output module, a gate of the second output transistor is electrically connected to the second terminal of the scanning signal input sub-module, and a second electrode of the second output transistor is electrically connected to the second clock signal terminal;

the scanning signal input sub-module is configured for charging the gate of the first output transistor and the gate of the second output transistor during a pre-charging period, a scanning signal input terminal of the first stage of shift register unit is electrically connected to an initial signal input terminal, and starting from the second stage of shift register unit, the shift register unit includes a scanning signal input terminal electrically connected to the output terminal of the scanning signal output module of the previous stage of shift register unit;

a first terminal of the first energy storage sub-module is electrically connected to the gate of the second output transistor, a second terminal of the first energy storage sub-module is electrically connected to the first electrode of the second output transistor, and the first energy storage sub-module is configured for maintaining a gate voltage of the second output transistor to be a turn-on voltage of the second output transistor during an output period of the shift register unit, until the output period of the shift register unit ends;

a first terminal of the second energy storage sub-module is electrically connected to the gate of the first output transistor, a second terminal of the second energy storage sub-module is electrically connected to the first electrode of the first output transistor, and the second energy storage sub-module is configured for maintaining a gate voltage of the first output transistor to be a turn-on voltage of the first output transistor during an output period of the shift register unit, until the output period of the shift register unit ends; and the first output control sub-module is configured for providing control signals to the first energy storage sub-module and the second energy storage sub-module during the output period so that the first energy storage sub-module and the second energy storage sub-module discharge during the output period.

Preferably, the scanning signal input sub-module includes a scanning signal input transistor and a switching transistor, a gate of the scanning signal input transistor is electrically connected to the first clock signal terminal, a first electrode of the scanning signal input transistor serves as the input terminal of the scanning signal input sub-module, and a second electrode of the scanning signal input transistor is electrically connected to a gate of the switching transistor; and a first electrode of the switching transistor is electrically connected to the first clock signal terminal, and a second electrode of the switching transistor is electrically connected to the gate of the first output transistor.

Preferably, the first output control sub-module includes a first pulldown control transistor, a second pulldown control transistor and a third pulldown control transistor, a gate of the first pulldown control transistor is electrically connected to the first clock signal terminal, a first electrode of the first pulldown control transistor is electrically connected to the second level signal input terminal, and a second electrode of the first pulldown control transistor is electrically connected to the gate of the first output transistor;

a gate of the second pulldown control transistor is electrically connected to the second electrode of the first pulldown control transistor, a first electrode of the second pulldown control transistor is electrically connected to the first level signal input terminal, and a second electrode of the second pulldown control transistor is electrically connected to a first electrode of the third pulldown control transistor; and a gate of the third pulldown control transistor is electrically connected to the second clock signal terminal, and a second electrode of the third pulldown control transistor is electrically connected to the gate of the second output transistor.

Preferably, the first energy storage sub-module includes a first storage capacitor, the second energy storage sub-module includes a second storage capacitor, a second terminal of the second storage capacitor is electrically connected to the first electrode of the first output transistor, and a first terminal of the second storage capacitor is electrically connected to the gate of the first output transistor; and a second terminal of the first storage capacitor is electrically connected to the first electrode of the second output transistor, and a first terminal of the first storage capacitor is electrically connected to the gate of the second output transistor.

Preferably, the light-emitting control signal output module includes a third output transistor, a fourth output transistor and a second output control sub-module, a first electrode of the third output transistor is electrically connected to the first level signal input terminal, a gate of the third output transistor serves as the input terminal of the light-emitting control signal output module, and a second electrode of the third output transistor is electrically connected to the output terminal of the light-emitting control signal output module;

a first electrode of the fourth output transistor is electrically connected to the output terminal of the light-emitting control signal output module, a gate of the fourth output transistor is electrically connected to a first terminal of the second output control sub-module, and a second electrode of the fourth output transistor is electrically connected to the second level signal input terminal; and the second output control sub-module is configured for outputting a valid control signal to the fourth output transistor during a light-emitting period of the backlight so that the fourth output transistor is turned on.

Preferably, the second output control sub-module includes a fourth pulldown control transistor, a fifth pulldown control transistor and a third energy storage sub-module, a gate of the fourth pulldown control transistor serves as the control terminal of the second output control sub-module, a first electrode of the fourth pulldown control transistor is electrically connected to the first level signal input terminal, and a second electrode of the fourth pulldown control transistor is electrically connected to a first electrode of the fifth pulldown control transistor;

a gate of the fifth pulldown control transistor is electrically connected to the first clock signal terminal, and a second electrode of the fifth pulldown control transistor is electrically connected to the second level signal input terminal; and a first terminal of the third energy storage sub-module is electrically connected to the second clock signal terminal, and a second terminal of the third energy storage sub-module is electrically connected to the gate of the fourth output transistor.

Preferably, the third energy storage sub-module includes a third storage capacitor, one terminal of the third storage capacitor serves as the first terminal of the third energy storage sub-module, and the other terminal of the storage capacitor serves as the second terminal of the third energy storage sub-module.

Preferably, among a same row of light-emitting units, every three light-emitting units form a light-emitting unit group, and in the same light-emitting unit group, the three light-emitting units are a red light-emitting unit, a green light-emitting unit and a blue light-emitting unit, respectively.

The invention further provides a display device, including a display panel and any one of the above backlights.

The invention further provides a display device, including a display panel and any one of the above backlights.

In the invention, by sequentially providing scanning signals to the plurality of backlight scanning lines so as to scan the respective light-emitting units row-by-row, and by using the plurality of backlight data lines to sequentially provide gray scale signals to the respective light-emitting units, the brightness of the respective light-emitting units can be controlled. Since the respective light-emitting units of the backlight independently emit light, and it is not required to arrange an optical film such as a diffuser plate in the backlight, the areas of the respective light-emitting units are not limited any more, and a plurality of light-emitting units can be arranged in the backlight. The brightness of the respective light-emitting units of the backlight can be controlled based on the display image of the display panel, so that the display device can display an image with a better contrast.

BRIEF DESCRIPTION OF THE DRAWINGS

The accompanying drawings are used to provide a further understanding of the invention, constitute a part of the specification, are used to interpret the invention in conjunction with the following embodiments, and do not limit the invention. In the drawings.

DESCRIPTION OF REFERENCE NUMERALS

100: backlight; 110: light-emitting circuit;
121: first anode; 122: second anode;
123: third anode; 130: cathode;
140: package cover plate; 150: data interface;
160: flexible circuit board; 171: scanning signal output module;
172: light-emitting control signal output module;
171*a*: scanning signal input sub-module;
171*b*: first output control sub-module;
172*a*: second output control sub-module.

DETAILED DESCRIPTION OF THE EMBODIMENTS

Embodiments of the invention will be described in detail below in conjunction with the drawings. It should be understood that, the embodiments described herein are only used to illustrate and interpret the invention, and do not limit the invention.

Figure 1:
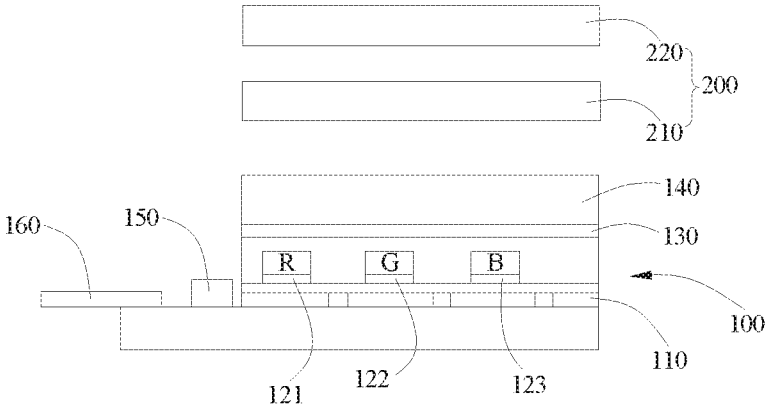
FIG. 1 shows a cross-sectional view of a display device provided by an embodiment of the invention.

As shown in FIG. 1, the invention provides a display device, which includes a display panel 200 and a backlight 100 for supplying a light source to the display panel 200. The display device may be any product or component with a display function such as a mobile phone, a tablet PC, a television, a monitor, a notebook computer, a digital photo frame, a navigator.

The backlight 100 includes a plurality of backlight scanning lines and a plurality of backlight data lines, the backlight scanning lines and the backlight data lines are provided in different layers, and the plurality of backlight scanning lines and the plurality of backlight data lines are intersected with each other to divide the backlight into a plurality of light-emitting units, each of which is provided with one light-emitting diode and a light-emitting circuit 110 for driving the light-emitting diode to emit light, the light-emitting circuits 110 for the same row of light-emitting units are electrically connected to a corresponding backlight scanning line, the light-emitting circuits 110 for the same column of light-emitting units are electrically connected to a corresponding backlight data line, the backlight scanning line is configured for providing a scanning signal to the light-emitting circuit, and the backlight data line is configured for providing a gray scale signal to the light-emitting circuit to control brightness of the light-emitting unit.

In the invention, since the respective light-emitting units of the backlight 100 independently emit light, and it is not required to arrange an optical film such as a diffuser plate in the backlight 100, the areas of the respective light-emitting units are not limited any more, and a plurality of light-emitting units can be arranged in the backlight 100. The brightness of the respective light-emitting units of the backlight 100 can be controlled based on the display image of the display panel 200, so that the display device can display an image with a better contrast.

It is easily understood that, the display panel 200 may be a liquid crystal display panel. For example, as shown in FIG. 1, the display panel 200 may include an array substrate 210 and a color filter substrate 220. Of course, the display panel 200 may also be other display panel which needs a backlight. For example, the display panel may be an electronic paper, or an electrochromic display panel.

In the invention, the light-emitting diodes may be considered to be arranged in the same layers, and the layers where the light-emitting diode is located include an anode pattern layer, a luminescent material layer and a cathode 130. FIG. 1 shows three light-emitting diodes in the same layers, that is, a red light-emitting diode, a green light-emitting diode and a blue light-emitting diode, and these three diodes share the cathode 130. The red light-emitting diode further includes a first anode 121 and a red luminescent layer R, the green light-emitting diode further includes a second anode 122 and a green luminescent layer G, and the blue light-emitting diode further includes a third anode 123 and a blue luminescent layer B.

In FIG. 1, the backlight further includes a flexible circuit board 160 for providing signals, a data interface 150 and a package cover plate 140. The flexible circuit board is used to provide light-emitting signals to the backlight, and the data interface 150 is used to transmit the light-emitting signals to the backlight.

It is easily understood that, in the invention, by sequentially providing scanning signals to the plurality of backlight scanning lines so as to scan the respective light-emitting units row-by-row, and by using the plurality of backlight data lines to sequentially provide gray scale signals to the respective light-emitting units, the brightness of the respective light-emitting units can be controlled.

Figure 2:
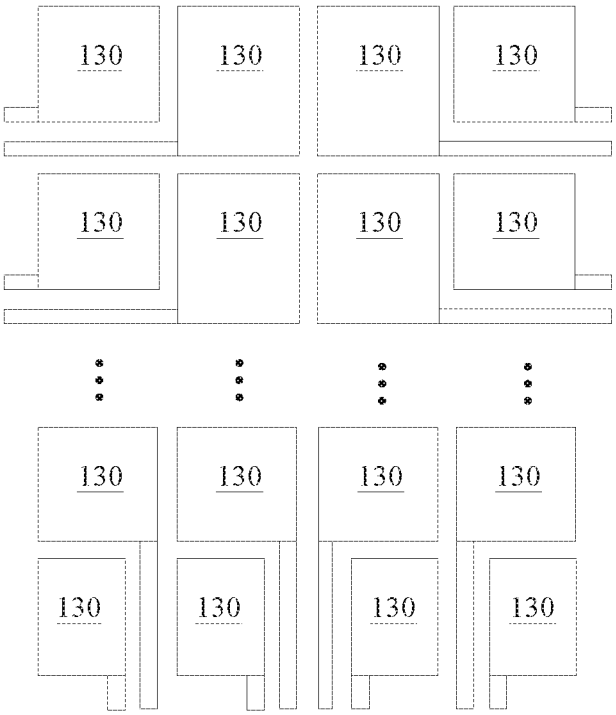
FIG. 2 shows a top view of a backlight provided by an embodiment of the invention.
Figure 3:
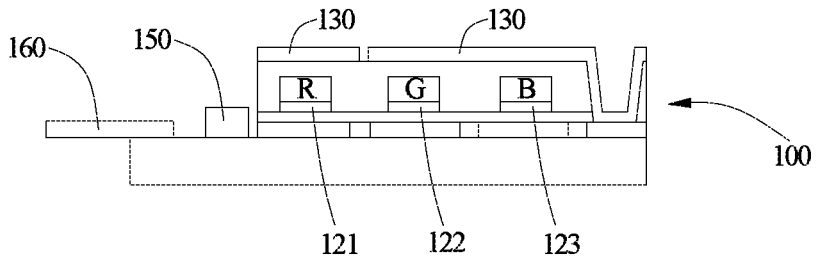
FIG. 3 shows a partially cross-sectional view of the backlight in FIG. 2.

In order to achieve a better control of brightness of the respective light-emitting units, preferably, the backlight 100 may be divided into at least two light-emitting regions, each of which includes at least one light-emitting unit, as shown in FIGS. 2 and 3, the light-emitting diodes in the same light-emitting region share the cathode 130, and the light-emitting diodes in different light-emitting regions correspond to different cathodes 130. Since different light-emitting regions correspond to different cathodes, brightness in different light-emitting regions will not affect each other, and thus it is easier to achieve a local dimming for the display device.

In the invention, the number of the light-emitting units in one light-emitting region is not particularly limited. For example, one light-emitting region includes only one light-emitting unit, or includes a plurality of light-emitting units. Preferably, one light-emitting region includes a plurality of light-emitting units to simplify the manufacturing process of the backlight.

Figure 4:
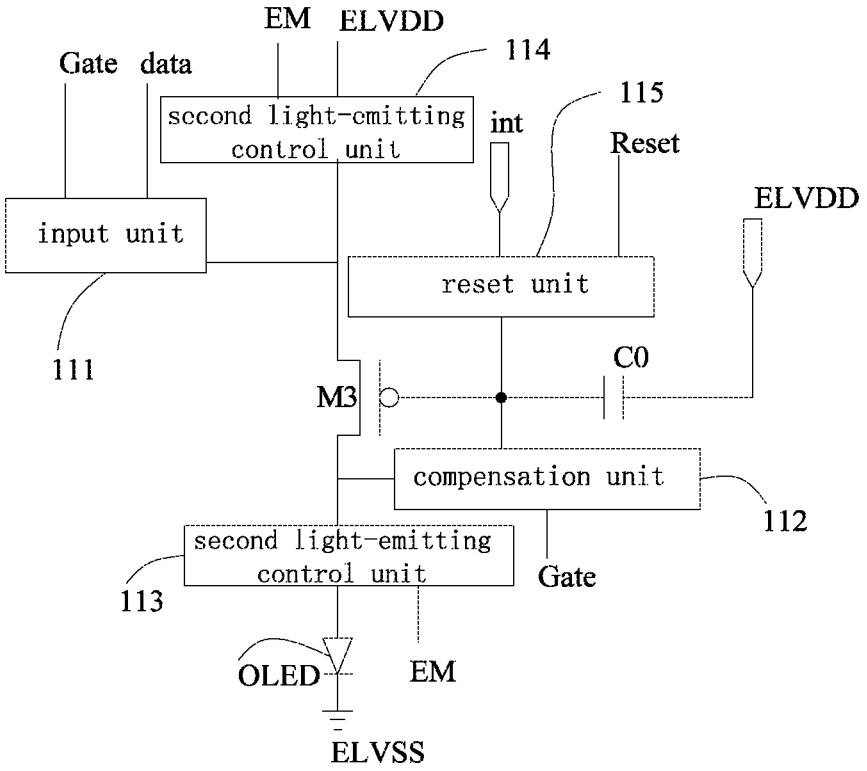
FIG. 4 shows a schematic view of a light-emitting unit of the backlight provided by the invention.

In the invention, there is no particular limitation to the configuration of the light-emitting circuit, as shown in FIG. 4, for example, the light-emitting circuit may include a gray scale signal input unit 111, a driving transistor M3, an energy storage unit C0, a compensation unit 112 and a high level signal input terminal ELVDD.

A gate of the driving transistor M3 is electrically connected to a first terminal of the energy storage unit C0, and a second terminal of the energy storage unit C0 is electrically connected to the high level signal input terminal ELVDD.

A control terminal of the gray scale signal input unit 111 is electrically connected to a corresponding backlight scanning line Gate, an input terminal of the gray scale signal input unit 111 is electrically connected to a backlight data line data, an output terminal of the gray scale signal input unit 111 is electrically connected to a first electrode of the driving transistor M3, and when a valid scanning signal received by the backlight scanning line Gate and a gray scale signal input by the backlight data line data are received by the control terminal of the gray scale signal input unit 111, the input terminal and the output terminal of the gray scale signal input unit 111 are conductive so as to store the gray scale signal in the energy storage unit C0.

A control terminal of the compensation unit 112 is electrically connected to the backlight scanning line Gate, an input terminal of the compensation unit 112 is electrically connected to a second electrode of the driving transistor M3, an output terminal of the compensation unit 112 is electrically connected to the first terminal of the energy storage unit C0, a second terminal of the energy storage unit C0 is electrically connected to the high level signal input terminal ELVDD. When a valid scanning signal output by the backlight scanning line Gate is received by the control terminal of the compensation unit 112, the input terminal and the output terminal of the compensation unit 112 are conductive so as to store a threshold voltage of the driving transistor M3 in the energy storage unit C0.

Figure 6:
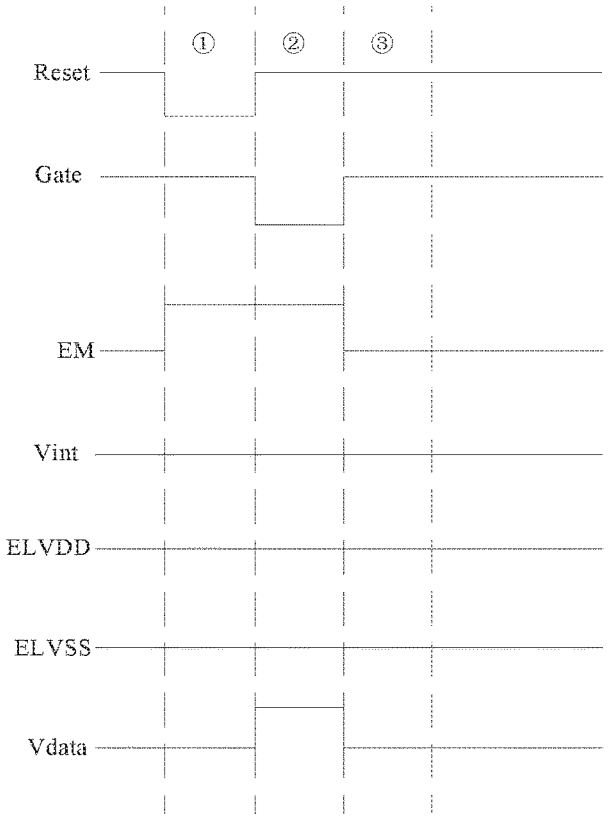
FIG. 6 illustrates a timing diagram of respective signals of the light-emitting unit in FIG. 4.

FIG. 6 illustrates a timing diagram of respective signals of the light-emitting circuit.

As shown in FIG. 6, the valid scanning signal is a low level signal. In the embodiment of the invention, the scanning signal and the gray scale signal are simultaneously provided in a same period.

In order to facilitate the description, the period of providing the scanning signal and the gray scale signal is referred to as a charging compensation period (i.e. the period ② in FIG. 6). In the charging compensation period, after the scanning signal is received by the control terminal of the gray scale signal input unit 111, the input terminal and the output terminal of the gray scale signal input unit 111 are conductive, and thus the gray scale input by the input terminal of the gray scale signal input unit 111 is transmitted to the first electrode of the driving transistor M3. At the same time, after the valid scanning signal is received by the control terminal of the compensation unit 112, the second electrode and the gate of the driving transistor M3 are conductive so that the driving transistor M3 serves as a diode. Thus, the storage capacitor C0 is charged by the gray scale signal via the driving transistor M3. When the charging compensation period ends, a gray scale signal voltage $V_{data}$ provided by the backlight data line data, a high level voltage $V_{dd}$ provided by the high level signal input terminal ELVDD and a threshold voltage $V_{th}$ of the driving transistor M3 are stored in the storage capacitor C0.

After the charging compensation period ends, the light-emitting circuit enters a light-emitting period (i.e. the period ③ in FIG. 6), and a current flowing through the light-emitting diode can be calculated with the following equation (1):

$$\begin{aligned} I_{OLED} &= K(V_{gs} - V_{th})^2 \quad (1) \\ &= K[V_{dd} - (V_{data} - V_{th}) - V_{th}]^2 \\ &= K[V_{dd} - V_{data}]^2 \end{aligned}$$

Wherein, $I_{OLED}$ is the current flowing through the light-emitting diode during the light-emitting period;

K is a constant associated with a width-to-length ratio of the driving transistor M3;

$V_{th}$ is the threshold voltage of the driving transistor M3;

$V_{gs}$ is a gate-source voltage difference of the driving transistor M3;

$V_{data}$ is the gray level signal voltage; and $V_{dd}$ is the high level voltage input by the high level signal input terminal ELVDD.

It can be seen from the equation (1) that, the current flowing through the light-emitting diode OLED is irrelevant to the threshold voltage of the driving transistor, that is, the threshold voltage shift of the driving transistor M3 will not affect magnitude of the current flowing through the light-emitting diode. Thus, the backlight has better light-emitting stability so that the display device has a better display effect.

In order to make the backlight have better light-emitting properties, preferably, the light-emitting circuit further includes a reset unit 115 and a reset voltage input terminal int. A control terminal of the reset unit 115 is electrically connected to a reset signal input terminal Reset, a first input terminal of the reset unit 115 is electrically connected to the gate of the driving transistor M3, a second input terminal of the reset unit 115 is electrically connected to the reset voltage input terminal int. When a valid reset signal is received by the control terminal of the reset unit 115, the first input terminal and the second input terminal of the reset unit 115 are conductive.

A reset period may be performed after the light-emitting stage, or may be performed before the charging compensation period (for example, the period (in FIG. 6). When the reset unit 115 receives a reset signal input by the reset signal input terminal Reset, the first input terminal and the second input terminal of the reset unit are conductive, that is, the first terminal of the energy storage unit and the reset voltage input terminal int are conductive, and the reset voltage input terminal int has a lower potential to discharge the energy storage unit and the gate of the driving transistor M3, so that both the driving transistor M3 and the energy storage unit restore an initial state, which will not affect display of the next frame.

The respective light-emitting diodes of the backlight only emit light during the light-emitting period, and do not emit light during other periods. In order to achieve this object, preferably, the backlight further includes a plurality of light-emitting control lines EM, each row of light-emitting units correspond to one light-emitting control line EM, the light-emitting circuit further includes a first light-emitting control unit 113, a control terminal of the first light-emitting control unit 113 is electrically connected to the light-emitting control line EM, an input terminal of the first light-emitting control unit 113 is electrically connected to the second electrode of the driving transistor M3, an output terminal of the first light-emitting control unit 113 is electrically connected to an anode of the light-emitting diode OLED, and when the light-emitting control line EM provides a valid light-emitting control signal, the input terminal and the output terminal of the first light-emitting control unit 113 are conductive.

After the input terminal and the output terminal of the first light-emitting control unit 113 are conductive, the anode of the light-emitting diode OLED and the second electrode of the driving transistor M3 are conductive, thus, the light-emitting diode OLED is driven to emit light by the current flowing through the driving transistor M3.

In order to prevent the voltage charged in the energy storage unit during the charging compensation period from being affected, preferably, the light-emitting circuit further includes a second light-emitting control unit 114, an input terminal of the second light-emitting control unit 114 is electrically connected to the high level signal input terminal ELVDD, an output terminal of the second light-emitting control unit 114 is electrically connected to the first terminal of the driving transistor M3, a control terminal of the second light-emitting control unit 114 is electrically connected to the light-emitting control line EM, and when the light-emitting control line EM provides the valid light-emitting control signal, the input terminal and the output terminal of the second light-emitting control unit 114 are conductive so that the high level signal input terminal ELVDD and the first electrode of the driving transistor M3 are conductive to ensure that the driving transistor M3 normally generates the driving current $I_{OLED}$ for driving the light-emitting diode to emit light.

Figure 5:
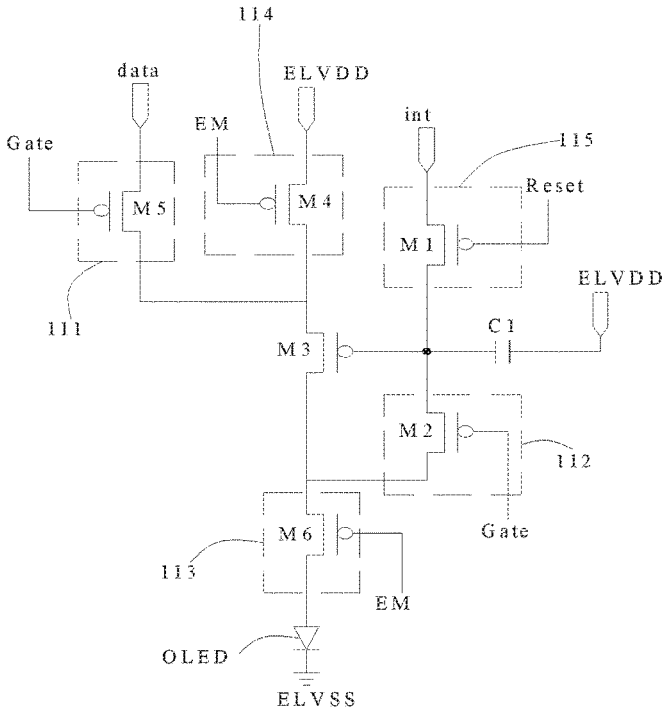
FIG. 5 shows a circuit diagram of the light-emitting unit in FIG. 4 provided by an embodiment of the invention.

In the invention, the configuration of the first light-emitting control unit 113 is not particularly limited. As one preferable embodiment of the invention, as shown in FIG. 5, the first light-emitting control unit 113 includes a first light-emitting control transistor M6, a gate of the first light-emitting control transistor M6 serves as the control terminal of the first light-emitting control unit 113, a first electrode of the first light-emitting control transistor M6 serves as the input terminal of the first light-emitting control unit 113, and a second electrode of the first light-emitting control transistor M6 serves as the output terminal of the first light-emitting control unit 113.

When the light-emitting control signal line EM provides a valid light-emitting control signal, the first light-emitting control transistor M6 is turned on. In the invention, the first light-emitting control transistor M6 is a P-type transistor, and thus the valid light-emitting control signal is a low level signal.

In the invention, the configuration of the second light-emitting control unit 114 is not particularly limited. As one preferable embodiment of the invention, as shown in FIG. 5, the second light-emitting control unit 114 includes a second light-emitting control transistor M4, a gate of the second light-emitting control transistor M4 serves as the control terminal of the second light-emitting control unit 114, a first electrode of the second light-emitting control transistor M4 serves as the input terminal of the second light-emitting control unit 114, and a second electrode of the second light-emitting control transistor M4 serves as the output terminal of the second light-emitting control unit 114.

When the light-emitting control signal line EM provides a valid light-emitting control signal, the second light-emitting control transistor M4 is turned on. In the invention, the second light-emitting control transistor M4 is a P-type transistor, and thus the valid light-emitting control signal is a low level signal.

Since the first light-emitting control transistor M6 and the second light-emitting control transistor M4 are connected to the same light-emitting control signal line EM, the first light-emitting control transistor M6 and the second light-emitting control transistor M4 are of the same type, both are P-type transistors or N-type transistors.

Of course, the first light-emitting control transistor M6 and the second light-emitting control transistor M4 may be controlled by different light-emitting control signal lines, respectively.

In the invention, the configuration of the gray scale signal input unit 111 is not particularly limited, for example, as shown in FIG. 5, the gray scale signal input unit 111 may include a gray scale signal input transistor M5, a gate of the gray scale signal input transistor M5 serves as the control terminal of the gray scale signal input unit 111, a first electrode of the gray scale signal input transistor M5 serves as the input terminal of the gray scale signal input unit 111, and a second electrode of the gray scale signal input transistor M5 serves as the output terminal of the gray scale signal input unit 111.

The gate of the gray scale signal input transistor M5 is electrically connected to the backlight source scanning line Gate, the first electrode of the gray scale signal input transistor M5 is electrically connected to the backlight data line data, and the second electrode of the gray scale signal input transistor M5 is electrically connected to the first electrode of the driving transistor M3. When the backlight scanning line Gate provides a valid scanning signal and the backlight data line data provides a gray scale signal, the gray scale signal input transistor M5 is turned on. In the embodiment shown in FIG. 5, the gray scale signal input transistor M5 is a P-type transistor, thus the valid scanning signal is a low level signal. Of course, the invention is not limited thereto, the gray scale signal input transistor M5 may be an N-type transistor. When the gray scale signal input transistor M5 is an N-type transistor, the valid scanning data is a high level signal.

In the invention, the configuration of the compensation unit 112 is not particularly limited. In the preferable embodiment shown in FIG. 5, the compensation unit 112 includes a compensation transistor M2, a gate of the compensation transistor M2 serves as the control terminal of the compensation unit 112, a first electrode of the compensation transistor M2 serves as the input terminal of the compensation unit 112, and a second electrode of the compensation transistor M2 serves as the output terminal of the compensation unit 112.

The gate of the compensation transistor M2 is electrically connected to the backlight scanning line, the second electrode of the compensation transistor M2 is electrically connected to the first terminal of the energy storage unit (i.e. the first terminal of the storage capacitor C1 in FIG. 5) and the gate of the driving transistor M3, and the first electrode of the compensation transistor M2 is electrically connected to the second electrode of the driving transistor M3. When the backlight scanning line Gate provides a valid scanning signal to the gate of the compensation transistor M2, the compensation transistor M2 is turned on so that the gate and the second electrode of the driving transistor M3 are conductive and thus the driving transistor M3 serves as a diode. In the embodiment shown in FIG. 5, since both the compensation transistor M2 and the gray scale signal input transistor M5 are electrically connected to the same backlight scanning line, they are of the same type, that is, the compensation transistor M2 is also a P-type transistor, and when receiving a scanning signal of a low level, the compensation transistor M2 is turned on.

In the invention, the configuration of the reset unit 115 is also not particularly limited. In the embodiment shown in FIG. 5, the reset unit 115 includes a reset transistor M1, a gate of the reset transistor M1 serves as the control terminal of the reset unit 115, a first electrode of the reset transistor M1 serves as the first terminal of the reset unit 115, and a second electrode of the reset transistor M1 serves as the second terminal of the reset unit 115.

The gate of the reset transistor M1 is electrically connected to the reset signal input terminal Reset, the first electrode of the reset transistor M1 is electrically connected to the initial signal input terminal int, and the second electrode of the reset transistor M1 is electrically connected to the first terminal of the energy storage module and the gate of the driving transistor M3. When the reset signal input terminal Reset provides a valid reset signal to the gate of the reset transistor M1, the reset transistor M1 is turned on so as to discharge the energy storage unit and the gate of the driving transistor M3.

In the invention, there is no special requirement on the initial voltage Vint provided by the initial signal input terminal int, and preferably, the initial signal input terminal is a ground terminal.

Figure 7:
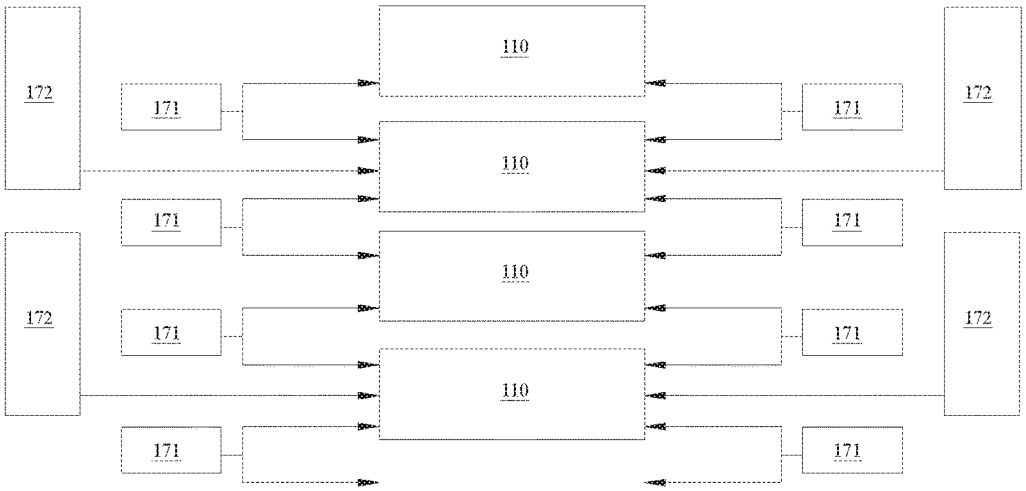
FIG. 7 shows a schematic view of a shift register provided by an embodiment of the invention.

In order to reduce thickness of the backlight and increase integration degree of the backlight, the backlight further includes a shift register, as shown in FIG. 7, the shift register includes a plurality of stages of shift register units which are cascaded, the shift register unit includes a scanning signal output module 171 and a light-emitting control signal output module 172, the scanning signal output module 171 is configured for providing a scanning signal to the backlight scanning line of the backlight, and the light-emitting control signal output module is configured for providing a light-emitting control signal to the light-emitting control signal line of the backlight.

In the invention, the relationship between the scanning signal output module and the light-emitting control signal output module is not particularly limited, as long as the scanning signal output module can output the scanning signal during the charging compensation period, and the light-emitting control signal output module can output the light-emitting control signal during the light-emitting period.

In order to further increase integration degree of the backlight, preferably, a control terminal of the light-emitting control signal output module is electrically connected to an output terminal of the scanning signal output module, and the light-emitting control signal output module is able to output the light-emitting control signal after receiving the scanning signal output by the scanning signal output module.

In the invention, the configuration of the shift register is not particularly limited. For example, in the particular embodiment shown in FIGS. 8 and 9, the shift register includes a first level signal input terminal VGH, a second level signal input terminal VGL, a first clock signal terminal CK and a second clock signal terminal CB. Timing of a first clock signal input by the first clock signal terminal CK is 180° out-of-phase with respect to timing of a second clock signal input by the second clock signal terminal CB. When a valid scanning signal is output by the output terminal of the scanning signal output module 171, the second clock signal input into the second clock signal terminal CB is also a valid clock signal, a first level signal input by the first level signal input terminal VGH is an invalid signal, and a second level signal input by the second level signal input terminal VGL is a valid signal.

Figure 8:
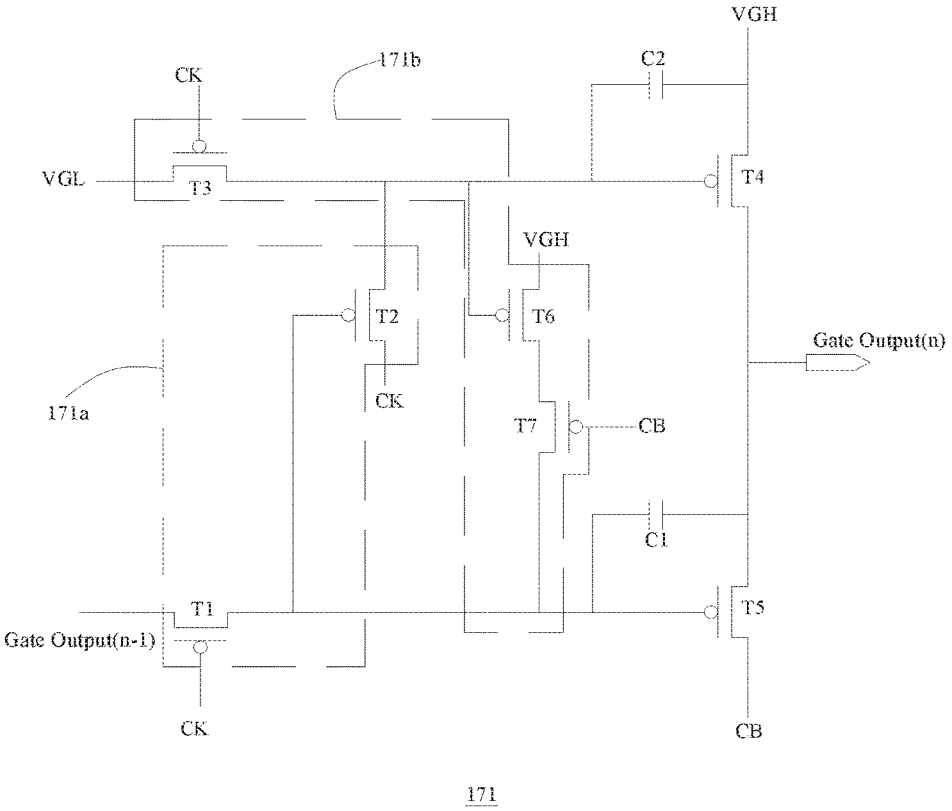
FIG. 8 shows a circuit diagram of a scanning signal output module in the nth stage of shift register unit included in the shift register shown in FIG. 7 provided by an embodiment of the invention.

As shown in FIG. 8, the scanning signal output module 171 includes a first output transistor T4, a second output transistor T5, a first output control sub-module 171*b*, a scanning signal input sub-module 171*a*, a first energy storage sub-module C1 and a second energy storage sub-module C2. FIG. 8 shows a circuit diagram of the nth stage of shift register unit.

A first electrode of the first output transistor T4 is electrically connected to the first level signal input terminal VGH, a gate of the first output transistor T4 is electrically connected to the first terminal of the scanning signal input sub-module 171*a*, and a second electrode of the first output transistor T4 is electrically connected to the output terminal Gate Output (n) of the scanning signal output module 171.

A first electrode of the second output transistor T5 is electrically connected to the output terminal Gate Output (n) of the scanning signal output module 171, a gate of the second output transistor T5 is electrically connected to the second terminal of the scanning signal input sub-module 171*a*, and a second electrode of the second output transistor T5 is electrically connected to the second clock signal terminal CB.

The scanning signal input sub-module 171*a* is configured for charging the gate of the first output transistor T4 and the gate of the second output transistor T5 during a pre-charging period. As a person skilled in the art may understand, a scanning signal input terminal of the first stage of shift register unit is electrically connected to an initial signal input terminal, and starting from the second stage of shift register unit, the shift register unit includes a scanning signal input terminal electrically connected to the output terminal of the scanning signal output module of the previous stage of shift register unit. The initial signal input terminal is configured for providing an initial signal STV. In the embodiment shown in FIGS. 8 and 9, the input terminal of the scanning signal input sub-module 171*a* in the nth stage of shift register unit is electrically connected to the output terminal Gate Output (n−1) of the scanning signal output module in the (n−1)th stage of shift register unit.

A first terminal of the first energy storage sub-module C1 is electrically connected to the gate of the second output transistor T5, a second terminal of the first energy storage sub-module C1 is electrically connected to the first electrode of the second output transistor T5, and the first energy storage sub-module C1 is configured for maintaining a gate voltage of the second output transistor T5 to be a turn-on voltage of the second output transistor T5 during an output period of the shift register unit (i.e. the period t2 in FIG. 10), until the output period of the shift register unit ends.

A first terminal of the second energy storage sub-module C2 is electrically connected to the gate of the first output transistor T4, a second terminal of the second energy storage sub-module C2 is electrically connected to the first electrode of the first output transistor T4, and the second energy storage sub-module C2 is configured for maintaining a gate voltage of the first output transistor T4 to be a turn-on voltage of the first output transistor T4 during an output period of the shift register unit, until the output period of the shift register unit ends.

The first output control sub-module 171*b* is configured for providing control signals to the first energy storage sub-module C1 and the second energy storage sub-module C2 during the output period so that the first energy storage sub-module C1 and the second energy storage sub-module C2 discharge during the output period.

Figure 9:
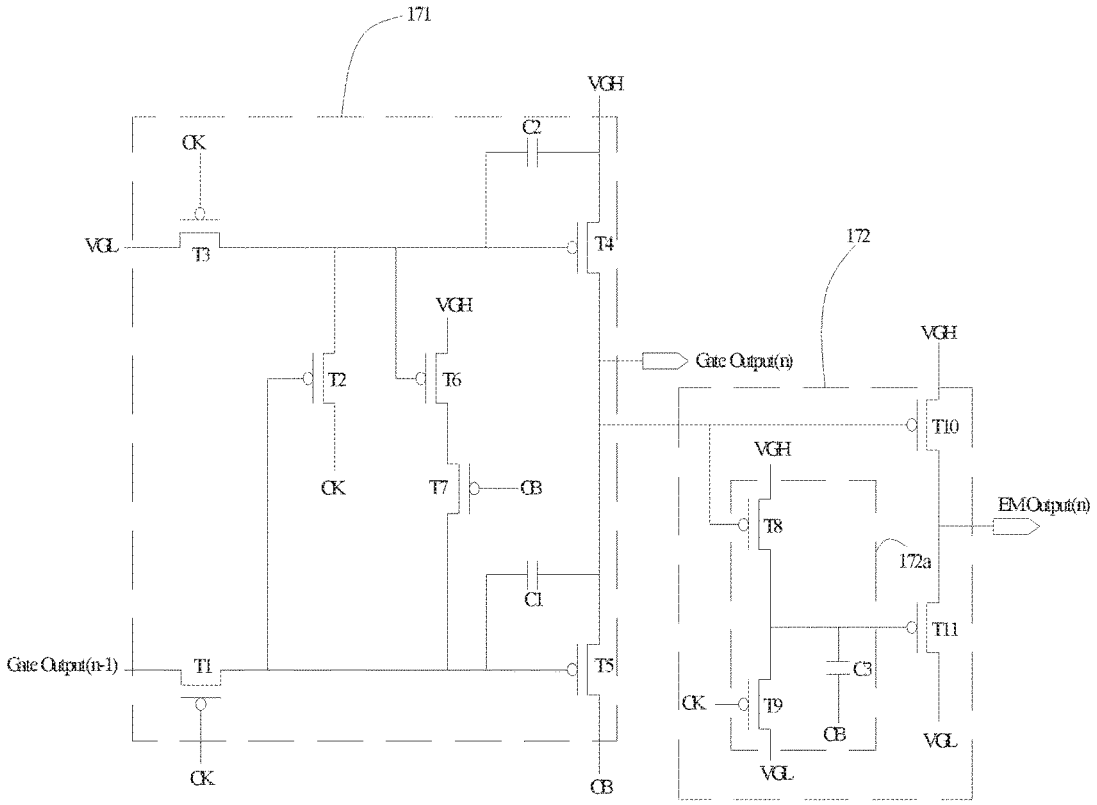
FIG. 9 shows a circuit diagram of the scanning signal output module and a light-emitting control signal output module in the nth stage of shift register unit included in the shift register shown in FIG. 7 provided by an embodiment of the invention.
Figure 10:
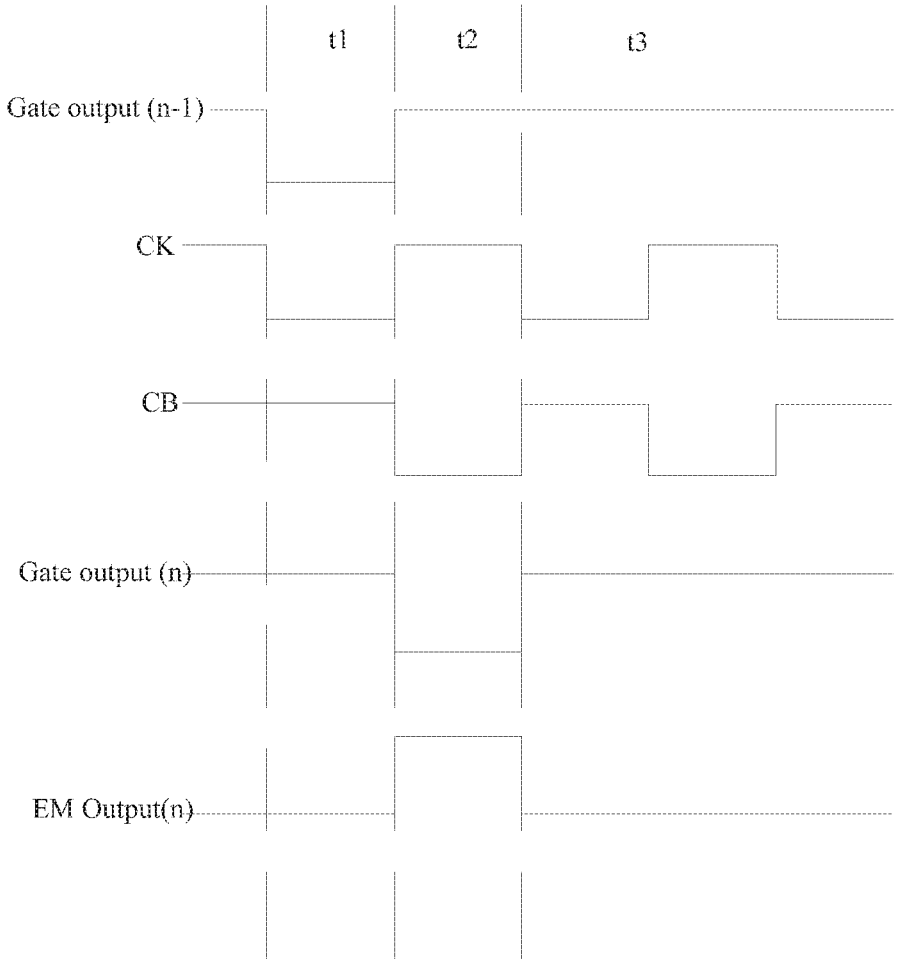
FIG. 10 illustrates a timing diagram of respective signals of the shift register in FIG. 9.

FIG. 10 illustrates a timing diagram of respective signals when the scanning signal output module 171 shown in FIGS. 8 and 9 operates.

As shown in FIG. 10, during the pre-charging period (i.e. the period t1 in FIG. 10), a valid scanning signal output by the output terminal Gate Output (n−1) of the scanning signal output module in the (n−1)th stage of shift register unit is received by the input terminal of the scanning signal input sub-module 171*a*, to charge the gate of the first output transistor T4 and the gate of the second output transistor T5. After the pre-charging period ends, the gate of the first output transistor T4 reaches the turn-on voltage, and the gate of the second output transistor T5 also reaches the turn-on voltage. At this time, since an invalid second clock signal is received by the second electrode of the second output transistor T5, and the first level signal input by the first level signal input terminal VGH is also received by the first electrode of the first output transistor T4, the output terminal of the scanning signal output module outputs an invalid scanning signal.

During the output period (i.e. the period t2 in FIG. 10), the first clock signal input by the first clock signal terminal CK is an invalid signal, and the second clock signal input by the second clock signal terminal CB is a valid signal. Since the first energy storage sub-module C1 maintains the second output transistor T5 in an ON state, and the second energy storage sub-module C2 maintains the first output transistor T4 in an ON state, the second clock signal input by the second clock signal terminal CB is output to the output terminal Gate Output (n) of the scanning signal output module 171. Sizes of the first output transistor T4 and the second output transistor T5 are adjusted so that the output terminal Gate Output (n) of the scanning signal output module 171 outputs a valid second clock signal, which is easily implemented by a person skilled in the art and the description thereof will be omitted herein. During this period, the first output control sub-module 171*b* provides control signals to the first energy storage sub-module C1 for the second output transistor T5 and the second energy storage sub-module C2 for the first output transistor T4, so that the first energy storage sub-module C1 and the second energy storage sub-module C2 discharge during the output period. After the discharging, the gates of the first output transistor T4 and the second output transistor T5 reach turn-off voltages, and the output period ends.

In the invention, the configuration of the scanning signal input sub-module 171*a* is not particularly limited, and in the embodiment shown in FIGS. 8 and 9, the scanning signal input sub-module 171*a* includes a scanning signal input transistor T1 and a switching transistor T2.

As shown in FIGS. 8 and 9, a gate of the scanning signal input transistor T1 is electrically connected to the first clock signal terminal CK, a first electrode of the scanning signal input transistor T1 serves as the input terminal of the scanning signal input sub-module 171*a* (i.e. is electrically connected to the output terminal Gate Output (n−1) of the scanning signal output module in the previous stage of shift register unit), and a second electrode of the scanning signal input transistor T1 is electrically connected to a gate of the switching transistor T2.

A first electrode of the switching transistor T2 is electrically connected to the first clock signal terminal CK, and a second electrode of the switching transistor T2 is electrically connected to the gate of the first output transistor T4.

In the embodiment provided by the invention, both the scanning signal input transistor T1 and the switching transistor T2 are P-type transistors. During the pre-charging period, the first clock signal input by the first clock signal terminal CK is a valid signal of a low level, thus the scanning signal input transistor T1 is turned on, a valid scanning signal is input to the gate of the switching transistor T2, and the switching transistor T2 is turned on. At this time, the first clock signal input by the second electrode of the switching transistor T2 is transmitted to the gate of the first output transistor T4 to charge the gate of the first output transistor T4 and the second energy storage sub-module C2. At this time, the scanning signal received by the scanning signal input sub-module 171*a* further charges the gate of the second output transistor T5 and the first energy storage sub-module C1.

In the invention, the configuration of the first output control sub-module 171*b* is not particularly limited. In the embodiment shown in FIGS. 8 and 9, the first output control sub-module 171*b* includes a first pulldown control transistor T3, a second pulldown control transistor T6 and a third pulldown control transistor T7.

As shown in FIGS. 8 and 9, a gate of the first pulldown control transistor T3 is electrically connected to the first clock signal terminal CK, a first electrode of the first pulldown control transistor T3 is electrically connected to the second level signal input terminal VGL, and a second electrode of the first pulldown control transistor T3 is electrically connected to the gate of the first output transistor T4.

A gate of the second pulldown control transistor T6 is electrically connected to the second electrode of the first pulldown control transistor T3, a first electrode of the second pulldown control transistor T6 is electrically connected to the first level signal input terminal VGH, and a second electrode of the second pulldown control transistor T6 is electrically connected to a first electrode of the third pulldown control transistor T7.

A gate of the third pulldown control transistor T7 is electrically connected to the second clock signal terminal CB, and a second electrode of the third pulldown control transistor T7 is electrically connected to the gate of the second output transistor T5.

During the pre-charging period, a valid first clock signal is input by the first clock signal terminal CK, the first pulldown control transistor T3 is turned on so that the second pulldown control transistor T6 is turned on, and since an invalid second clock signal is input by the second clock signal terminal CB, the third pulldown control transistor T7 is turned off, and during the pre-charging period, the second output transistor T5 will not be affected by the first output control sub-module 171*b*.

During the output period, the first clock signal input by the first clock signal terminal CK is an invalid signal, thus the first pulldown control transistor T3 is turned off, the gate voltage of the second pulldown control transistor T6 is the same as that of the first output transistor T4, and the second pulldown control transistor T6 is turned on. Since the second clock signal input by the second clock signal terminal CB is a valid signal, the third pulldown control transistor T7 is turned on so that the first level signal input by the first level signal terminal VGH is input to the gate of the second output transistor T5, and the first level signal is provided to the gate of the second output transistor T5 so that the second output transistor T5 is turned off after the second clock signal is output to the output terminal of the scanning signal output module 171.

In the invention, preferably, the first energy storage sub-module C1 includes a first storage capacitor, and the second energy storage sub-module C2 includes a second energy storage capacitor.

A second terminal of the second energy storage capacitor is electrically connected to the first electrode of the first output transistor T4, and a first terminal of the second energy storage capacitor is electrically connected to the gate of the first output transistor T4.

A second terminal of the first energy storage capacitor is electrically connected to the first electrode of the second output transistor T5, and a first terminal of the first energy storage capacitor is electrically connected to the gate of the second output transistor T5.

In the invention, the configuration of the light-emitting control signal output module 172 is not particularly limited, for example, as one preferable embodiment of the invention, as shown in FIG. 9, the light-emitting control signal output module 172 includes a third output transistor T10, a fourth output transistor T11 and a second output control sub-module 172*a*. FIG. 9 shows a schematic view of the nth stage of the shift register unit.

As shown in the figure, a first electrode of the third output transistor T10 is electrically connected to the first level signal input terminal VGH, a gate of the third output transistor T10 serves as the input terminal of the light-emitting control signal output module 172, and a second electrode of the third output transistor T10 is electrically connected to the output terminal EM Output (n) of the light-emitting control signal output module 172.

A first electrode of the fourth output transistor T11 is electrically connected to the output terminal EM Output (n) of the light-emitting control signal output module 172, a gate of the fourth output transistor T11 is electrically connected to a first terminal of the second output control sub-module 172*a*, and a second electrode of the fourth output transistor T11 is electrically connected to the second level signal input terminal VGL.

The second output control sub-module 172*a* is configured for outputting a valid control signal to the fourth output transistor T11 during a light-emitting period of the display device so that the fourth output transistor T11 is turned on.

In the invention, the configuration of the second output control sub-module 172*a* is not particularly limited, for example, in the embodiment shown in FIG. 9, the second output control sub-module 172*a* includes a fourth pulldown control transistor T8, a fifth pulldown control transistor T9 and a third energy storage sub-module C3.

A gate of the fourth pulldown control transistor T8 serves as the control terminal of the second output control sub-module 172*a*, a first electrode of the fourth pulldown control transistor T8 is electrically connected to the first level signal input terminal VGH, and a second electrode of the fourth pulldown control transistor T8 is electrically connected to a first electrode of the fifth pulldown control transistor T9.

A gate of the fifth pulldown control transistor T9 is electrically connected to the first clock signal terminal CK, and a second electrode of the fifth pulldown control transistor T9 is electrically connected to the second level signal input terminal VGL.

A first terminal of the third energy storage sub-module C3 is electrically connected to the second clock signal terminal CB, and a second terminal of the third energy storage sub-module C3 is electrically connected to the gate of the fourth output transistor T11.

In the invention, preferably, the third energy storage sub-module C3 includes a third storage capacitor, one terminal of the third storage capacitor serves as the first terminal of the third energy storage sub-module C3, and the other terminal of the third storage capacitor serves as the second terminal of the third energy storage sub-module C3.

The working principle of the shift register unit will be described below in conjunction with FIGS. 8 and 9. In the embodiment shown in FIG. 9, all the transistors are P-type transistors, thus a valid signal is of low level, and an invalid signal is of high level. The shift register unit shown in FIG. 9 cooperates with the light-emitting circuit in FIG. 5, in which all the transistors are P-type transistors, thus as for the light-emitting circuit in FIG. 5, a valid signal is of low level, and an invalid signal is of high level. Thus, in the following, when the circuit in FIG. 9 outputs a valid scanning signal, it indicates that the circuit in FIG. 9 outputs a scanning signal of low level, and when the circuit in FIG. 9 outputs an invalid scanning signal, it indicates that the circuit in FIG. 9 outputs a scanning signal of high level.

As shown in FIG. 10, one working cycle of the shift register unit includes a pre-charging period t1, an output period t2 and a light-emitting period t3.

During the pre-charging period t1, the a valid scanning signal is output by the scanning signal output terminal Gate Output (n−1) of the previous stage of shift register unit, and the first clock signal input by the first clock signal terminal CK is a valid signal, thus the scanning signal input transistor T1 is turned on, the first pulldown control transistor T3 is turned on, the switching transistor T2 is turned on to charge the second storage capacitor C2, and the first output transistor T4 is turned on. At the same time, the scanning signal passing through the scanning signal input transistor TI further charges the gate of the second output transistor T5 and the first storage capacitor C1. In this period, both the first output transistor T4 and the second output transistor T5 are turned on, at this time, since an invalid second clock signal is received by the second electrode of the second output transistor T5, and the first level signal input by the first level signal input terminal VGH is also received by the first electrode of the first output transistor T4, the output terminal of the scanning signal output module outputs an invalid scanning signal.

During the output period t2, the first clock signal input by the first clock signal terminal CK is an invalid signal, and the second clock signal input by the second clock signal terminal CB is a valid signal. Since the second storage capacitor maintains the first output transistor T4 in an ON state, and the first storage capacitor maintains the second output transistor T5 in an ON state, the second clock signal input by the second clock signal terminal CB is output to the output terminal Gate Output (n) of the scanning signal output module 171. Sizes of the first output transistor T4 and the second output transistor T5 are adjusted so that the output terminal Gate Output (n) of the scanning signal output module 171 outputs a valid second clock signal, which is easily implemented by a person skilled in the art and the description thereof will be omitted herein. During this period, the first output control sub-module 171*b* provides control signals to the first energy storage sub-module for the second output transistor T5 and the second energy storage sub-module for the first output transistor T4, so that the first energy storage sub-module and the second energy storage sub-module discharge during the output period. After the discharging, the gates of the first output transistor T4 and the second output transistor T5 reach turn-off voltages, and the output period ends.

Also during the output period t2, the output valid signal causes the third pulldown control transistor T8 and the third output transistor T10 to be turned on. After the third pulldown control transistor T8 is turned on, the first level signal input by the first level signal input terminal VGH is input to the gate of the fourth pulldown control transistor T11, so that the fourth pulldown control transistor T11 is turned off, thus the light-emitting control signal output module 172 outputs an invalid light-emitting control signal.

During the light-emitting period t3, the first clock signal input by the first clock signal terminal CK is a valid signal, and the second clock signal input by the second clock signal terminal CB is an invalid signal. Thus, the fifth pulldown control transistor T9 is turned on and transmits the second level signal provided by the second level signal input terminal VGL to charge the third storage capacitor C3, and due to the third storage capacitor C3, the gate of the fourth output transistor T11 is pulled down to a lower potential so as to ensure and maintain the fourth output transistor T11 in an ON state, and ensure that the output terminal EM Output (n) of the light-emitting control signal output module outputs the second level signal input by the second level signal input terminal VGL.

In the invention, all the light-emitting diodes may be the light-emitting diodes for emitting white light. However, the invention is not limited thereto.

In one preferable embodiment of the invention, of a same row of light-emitting units, every three light-emitting units form a light-emitting unit group, and in a same light-emitting unit group, the three light-emitting units are a red light-emitting unit, a green light-emitting unit and a blue light-emitting unit, respectively. By adjusting light emitted from different light-emitting units, brightness and color at the respective regions of the backlight can be adjusted, and by further cooperating with the gray scale signal of the display panel, a better display effect can be achieved.

As another aspect of the invention, a driving method of a display device is provided, and the display device is the above display device provided by the invention. The driving method includes the step of adjusting brightness of the respective light-emitting units of the backlight based on the image to be displayed by the display panel.

It should be understood that, the foregoing embodiments are only exemplary embodiments used for explaining the principle of the present invention, but the present invention is not limited thereto. Various variations and improvements may be made by a person skilled in the art without departing from the protection scope of the present invention, and these variations and improvements also fall into the protection scope of the present invention.

What is claimed is:

1. A backlight for supplying a light source to a display panel, including a plurality of backlight scanning lines and a plurality of backlight data lines, wherein the plurality of backlight scanning lines and the plurality of backlight data lines are provided in different layers, and the plurality of backlight scanning lines and the plurality of backlight data lines are intersected with each other to divide the backlight into a plurality of light-emitting units, each of which is provided therein with one light-emitting diode and a light-emitting circuit for driving the light-emitting diode to emit light, the light-emitting circuits for a same row of light-emitting units are electrically connected to a corresponding backlight scanning line, the light-emitting circuits for a same column of light-emitting units are electrically connected to a corresponding backlight data line, the backlight scanning line is configured for providing a scanning signal to the light-emitting circuit, and the backlight data line is configured for providing a gray scale signal to the light-emitting circuit to control brightness of the light-emitting unit, wherein the backlight is divided into at least two light-emitting regions, each light-emitting region includes at least one light-emitting unit, the light-emitting diodes in a same light-emitting region share a cathode, and the light-emitting diodes in different light-emitting regions correspond to different cathodes.

2. The backlight of claim 1, wherein the light-emitting circuit includes a gray scale signal input unit, a driving transistor, an energy storage unit, a compensation unit and a high level signal input terminal, a gate of the driving transistor is electrically connected to a first terminal of the energy storage unit, and a second terminal of the energy storage unit is electrically connected to the high level signal input terminal;

a control terminal of the gray scale signal input unit is electrically connected to a corresponding backlight scanning line, an input terminal of the gray scale signal input unit is electrically connected to a corresponding backlight data line, an output terminal of the gray scale signal input unit is electrically connected to a first electrode of the driving transistor, and when a valid scanning signal received by the backlight scanning line and a gray scale signal input by the backlight data line is received by the control terminal of the gray scale signal input unit, the input terminal and the output terminal of the gray scale signal input unit are conductive so as to store the gray scale signal in the energy storage unit;

a control terminal of the compensation unit is electrically connected to the backlight scanning line, an input terminal of the compensation unit is electrically connected to a second electrode of the driving transistor, an output terminal of the compensation unit is electrically connected to the first terminal of the energy storage unit, and when a valid scanning signal output by the backlight scanning line is received by the control terminal of the compensation unit, the input terminal and the output terminal of the compensation unit are conductive so as to store a threshold voltage of the driving transistor in the energy storage unit.

3. The backlight of claim 2, wherein the light-emitting circuit further includes a reset unit and a reset voltage input terminal, a control terminal of the reset unit is electrically connected to a reset signal input terminal, a first input terminal of the reset unit is electrically connected to the gate of the driving transistor, a second input terminal of the reset unit is electrically connected to the reset voltage input terminal, and when a valid reset signal is received by the control terminal of the reset unit, the first input terminal and the second input terminal of the reset unit are conductive.

4. The backlight of claim 3, wherein the reset unit includes a reset transistor, a gate of the reset transistor serves as the control terminal of the reset unit, a first electrode of the reset transistor serves as the first terminal of the reset unit, and a second electrode of the reset transistor serves as the second terminal of the reset unit.

5. The backlight of claim 2, wherein the backlight further includes a plurality of light-emitting control lines, each row of light-emitting units correspond to one light-emitting control line, the light-emitting circuit further includes a first light-emitting control unit, a control terminal of the first light-emitting control unit is electrically connected to the light-emitting control line, an input terminal of the first light-emitting control unit is electrically connected to the second electrode of the driving transistor, an output terminal of the first light-emitting control unit is electrically connected to an anode of the light-emitting diode, and when the light-emitting control line provides a valid light-emitting control signal, the input terminal and the output terminal of the first light-emitting control unit are conductive.

6. The backlight of claim 5, wherein the light-emitting circuit further includes a second light-emitting control unit, an input terminal of the second light-emitting control unit is electrically connected to the high level signal input terminal, an output terminal of the second light-emitting control unit is electrically connected to the first terminal of the driving transistor, a control terminal of the second light-emitting control unit is electrically connected to the light-emitting control line, and when the light-emitting control line provides the valid light-emitting control signal, the input terminal and the output terminal of the second light-emitting control unit are conductive.

7. The backlight of claim 6, wherein the first light-emitting control unit includes a first light-emitting control transistor, a gate of the first light-emitting control transistor serves as the control terminal of the first light-emitting control unit, a first electrode of the first light-emitting control transistor serves as the input terminal of the first light-emitting control unit, and a second electrode of the first light-emitting control transistor serves as the output terminal of the first light-emitting control unit; and the second light-emitting control unit includes a second light-emitting control transistor, a gate of the second light-emitting control transistor serves as the control terminal of the second light-emitting control unit, a first electrode of the second light-emitting control transistor serves as the input terminal of the second light-emitting control unit, and a second electrode of the second light-emitting control transistor serves as the output terminal of the second light-emitting control unit.

8. The backlight of claim 5, wherein the backlight includes a shift register, the shift register includes a plurality of stages of shift register units which are cascaded, the shift register unit includes a scanning signal output module and a light-emitting control signal output module, the scanning signal output module is configured for providing a scanning signal to the backlight scanning line of the backlight, and the light-emitting control signal output module is configured for providing a light-emitting control signal to the light-emitting control signal line of the backlight.

9. The backlight of claim 8, wherein a control terminal of the light-emitting control signal output module is electrically connected to an output terminal of the scanning signal output module, and the light-emitting control signal output module is able to output the light-emitting control signal after receiving the scanning signal output by the scanning signal output module.

10. The backlight of claim 8, wherein the shift register includes a first level signal input terminal, a second level signal input terminal, a first clock signal terminal and a second clock signal terminal, timing of a first clock signal input by the first clock signal terminal is 180° out-of-phase with respect to timing of a second clock signal input by the second clock signal terminal, and when a valid scanning signal is output by the output terminal of the scanning signal output module, the second clock signal is a valid signal, a first level signal input by the first level signal input terminal is an invalid signal, and a second level signal input by the second level signal input terminal is a valid signal;

the scanning signal output module includes a first output transistor, a second output transistor, a first output control sub-module, a scanning signal input sub-module, a first energy storage sub-module and a second energy storage sub-module;

a first electrode of the first output transistor is electrically connected to the first level signal input terminal, a gate of the first output transistor is electrically connected to the first terminal of the scanning signal input sub-module, and a second electrode of the first output transistor is electrically connected to the output terminal of the scanning signal output module;

a first electrode of the second output transistor is electrically connected to the output terminal of the scanning signal output module, a gate of the second output transistor is electrically connected to the second terminal of the scanning signal input sub-module, and a second electrode of the second output transistor is electrically connected to the second clock signal terminal;

the scanning signal input sub-module is configured for charging the gate of the first output transistor and the gate of the second output transistor during a pre-charging period, a scanning signal input terminal of the first stage of shift register unit is electrically connected to an initial signal input terminal, and starting from the second stage of shift register unit, the shift register unit includes a scanning signal input terminal electrically connected to the output terminal of the scanning signal output module of the previous stage of shift register unit;

a first terminal of the first energy storage sub-module is electrically connected to the gate of the second output transistor, a second terminal of the first energy storage sub-module is electrically connected to the first electrode of the second output transistor, and the first energy storage sub-module is configured for maintaining a gate voltage of the second output transistor to be a turn-on voltage of the second output transistor during an output period of the shift register unit, until the output period of the shift register unit ends;

a first terminal of the second energy storage sub-module is electrically connected to the gate of the first output transistor, a second energy storage sub-module is electrically connected to the first output transistor, and the second energy storage sub-module is configured for maintaining a gate voltage of the first output transistor to be a turn-on voltage of the first output transistor during an output period of the shift register unit, until the output period of the shift register unit ends; and the first output control sub-module is configured for providing control signals to the first energy storage sub-module and the second energy storage sub-module during the output period so that the fist energy storage sub-module and the second energy storage sub-module discharge during the output period.

11. The backlight of claim 10, wherein the scanning signal input sub-module includes a scanning signal input transistor and a switching transistor, a gate of the scanning signal input transistor is electrically connected to the first clock signal terminal, a first electrode of the scanning signal input transistor serves as the input terminal of the scanning signal input sub-module, and a second electrode of the scanning signal input transistor is electrically connected to a gate of the switching transistor; and a first electrode of the switching transistor is electrically connected to the first clock signal terminal, and a second electrode of the switching transistor is electrically connected to the gate of the first output transistor.

12. The backlight of claim 10, wherein the first output control sub-module includes a first pulldown control transistor, a second pulldown control transistor and a third pulldown control transistor, a gate of the first pulldown control transistor is electrically connected to the first clock signal terminal, a first electrode of the first pulldown control transistor is electrically connected to the second level signal input terminal, and a second electrode of the first pulldown control transistor is electrically connected to the gate of the first output transistor;

a gate or the second pulldown control transistor is electrically connected to the second electrode of the first pulldown control transistor, a first electrode of the second pulldown control transistor is electrically connected to the first level signal input terminal, and a second electrode of the second pulldown control transistor is electrically connected to a first electrode of the third pulldown control transistor; and a gate of the third pulldown control transistor is electrically connected to the second clock signal terminal, and a second electrode of the third pulldown control transistor is electrically connected to the gate of the second output transistor.

13. The backlight of claim 10, wherein the first energy storage sub-module includes a first storage capacitor, the second energy storage sub-module includes a second storage capacitor, a second terminal of the second storage capacitor is electrically connected to the first electrode of the first output transistor, and a first terminal of the second storage capacitor is electrically connected to the gate of the first output transistor; and a second terminal of the first storage capacitor is electrically connected to the first electrode of the second output transistor, and a first terminal of the first storage capacitor is electrically connected to the gate of the second output transistor.

14. The backlight of claim 8, wherein the light-emitting control signal output module includes a third output transistor, a fourth output transistor and a second output control sub-module, a first electrode of the third output transistor is electrically connected to the first level signal input terminal, a gate of the third output transistor serves as the input terminal of the light-emitting control signal output module, and a second electrode of the third output transistor is electrically connected to the output terminal of the light-emitting control signal output module;

a first electrode of the fourth output transistor is electrically connected to the output terminal of the light-emitting control signal output module, a gate of the fourth output transistor is electrically connected to a first terminal of the second output control sub-module, and a second electrode of the fourth output transistor is electrically connected to the second level signal input terminal; and the second output control sub-module is configured for outputting a valid control signal to the fourth output transistor during a light-emitting period of the backlight so that the fourth output transistor is turned on.

15. The backlight of claim 14, wherein the second output control sub-module includes a fourth pulldown control transistor, a fifth pulldown control transistor and a third energy storage sub-module, a gate of the fourth pulldown control transistor serves as the control terminal of the second output control sub-module, a first electrode of the fourth pulldown control transistor is electrically connected to the first level signal input terminal, and a second electrode of the fourth pulldown control transistor is electrically connected to a first electrode of the fifth pulldown control transistor;

a gate of the fifth pulldown control transistor is electrically connected to the first clock signal terminal, and a second electrode of the fifth pulldown control transistor is electrically connected to the second level signal input terminal; and a first terminal of the third energy storage sub-module is electrically connected to the second clock signal terminal, and a second terminal of the third energy storage sub-module is electrically connected to the gate of the fourth output transistor.

16. The backlight of claim 2, wherein the gray scale signal input unit includes a gray scale signal input transistor, a gate of the gray scale signal input transistor serves as the control terminal of the gray scale signal input unit, a first electrode of the gray scale signal input transistor serves as the input terminal of the gray scale signal input unit, and a second electrode of the gray scale signal input transistor serves as the output terminal of the gray scale signal input unit.

17. The backlight of claim 2, wherein the compensation unit includes a compensation transistor, a gate of the compensation transistor serves as the control terminal of the compensation unit, a first electrode of the compensation transistor serves as the input terminal of the compensation unit, and a second electrode of the compensation transistor serves as the output terminal of the compensation unit.

18. The backlight of claim 1, wherein among a same row of light-emitting units, every three light-emitting units form a light-emitting unit group, and in a same light-emitting unit group, the three light-emitting units are a red light-emitting unit, a green light-emitting unit and a blue light-emitting unit, respectively.

19. A display device, including a display panel and the backlight of claim 1.

* * * * *